US010851651B2

(12) United States Patent
Bischof et al.

(10) Patent No.: US 10,851,651 B2
(45) Date of Patent: Dec. 1, 2020

(54) MESH HANDLING DEVICE FOR MINING OR TUNNELLING EQUIPMENT

(71) Applicant: SANDVIK INTELLECTUAL PROPERTY AB, Sandviken (SE)

(72) Inventors: Andreas Bischof, Obdach (AT); Thomas Galler, Katsch/Mur (AT); Martin Kupper, Velden am Worthersee (AT)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/079,192

(22) PCT Filed: Feb. 24, 2016

(86) PCT No.: PCT/EP2016/053839
§ 371 (c)(1),
(2) Date: Aug. 23, 2018

(87) PCT Pub. No.: WO2017/144090
PCT Pub. Date: Aug. 31, 2017

(65) Prior Publication Data

US 2019/0048719 A1 Feb. 14, 2019

(51) Int. Cl.
*E21D 11/40* (2006.01)
*E21D 11/15* (2006.01)

(52) U.S. Cl.
CPC ..... *E21D 11/40* (2013.01); *E21D 11/152* (2013.01)

(58) Field of Classification Search
CPC ..... E21D 11/406; E21D 11/40; E21D 11/15; E21D 11/152
USPC ..... 405/142, 146, 288, 302.3
See application file for complete search history.

(56) References Cited

U.S. PATENT DOCUMENTS

| | | | | |
|---|---|---|---|---|
| 5,816,750 | A | 10/1998 | Steffenino | |
| 5,870,872 | A * | 2/1999 | Hinnen | E04F 21/1811 182/141 |
| 8,137,033 | B1 | 3/2012 | Hinshaw et al. | |
| 2003/0230925 | A1 | 12/2003 | Oishi | |
| 2008/0279627 | A1 | 11/2008 | Junker et al. | |
| 2012/0213598 | A1* | 8/2012 | Lugg | E21C 27/24 405/290 |
| 2014/0070599 | A1* | 3/2014 | Steinberg | E21D 9/1026 299/64 |
| 2015/0086280 | A1* | 3/2015 | Lugg | E21C 27/24 405/290 |

FOREIGN PATENT DOCUMENTS

| | | | |
|---|---|---|---|
| DE | 2704222 | * | 8/1978 |
| DE | 2704222 | A1 | 8/1978 |
| DE | 2836659 | A1 | 3/1980 |

(Continued)

*Primary Examiner* — Sean D Andrish
(74) *Attorney, Agent, or Firm* — Corrine R. Gorski

(57) ABSTRACT

A mesh handler for a mining machine includes a generally U-shaped frame arranged for receiving and positioning at least one mesh against a roof portion of an underground tunnel. The frame includes at least one generally U-shaped rail and a guide mechanism arranged for guiding the mesh along the rail in a direction substantially perpendicular to a longitudinal direction of the mining machine. Moreover, a mining machine including the mesh handler is provided.

17 Claims, 11 Drawing Sheets

(56) References Cited

FOREIGN PATENT DOCUMENTS

| | | | |
|---|---|---|---|
| DE | 8021912 | U1 | 1/1981 |
| DE | 3107876 | A1 | 9/1982 |
| DE | 202111050143 | U1 | 10/2012 |
| EP | 1298283 | A1 | 9/2001 |
| GB | 1244574 | A | 9/1971 |
| RU | 2522325 | C1 | 7/2014 |
| WO | 02103162 | A1 | 12/2002 |
| WO | 2010050872 | A1 | 5/2010 |
| WO | 2011093777 | A1 | 8/2011 |
| WO | 2012156841 | A2 | 11/2012 |
| WO | 2012156842 | A2 | 11/2012 |
| WO | 2012156884 | A2 | 11/2012 |
| WO | 2014028924 | A1 | 2/2014 |
| WO | 2014090589 | A2 | 6/2014 |

* cited by examiner

MESH HANDLING DEVICE FOR MINING OR TUNNELLING EQUIPMENT

RELATED APPLICATION DATA

This application is a § 371 National Stage Application of PCT International Application No. PCT/EP2016/053839 filed Feb. 24, 2016.

FIELD OF INVENTION

The present invention relates to a mesh handler for a mining machine.

Furthermore, the present invention relates to a mining machine for use in subterranean roadways, in particular suitable for creating tunnels or in subterranean roadways and the like.

BACKGROUND ART

A variety of different types of excavation machines have been developed for cutting drifts, tunnels, subterranean roadways and the like in which a rotatable head is mounted on an arm that is in turn movably mounted at a main frame so as to create a desired tunnel cross sectional profile. WO2012/156841, WO 2012/156842, WO 2010/050872, WO 2012/156884, WO2011/093777, DE 20 2111 050 143 U1. All described apparatus for mill cutting of rock and minerals in which a rotating cutting head forced into contact with the rock face as supported by a movable arm. In particular, WO 2012/156884 describes the cutting end of the machine in which the rotatable heads are capable of being raised and lowered vertically and deflecting in the lateral sideways direction by a small angle in an attempt to try enhance the cutting action.

WO 2014/090589 describes a machine for digging roadways tunnels and the like in which a plurality of cutting heads are movable to dig into the rock face via a pivoting arcuate cutting path. US 2003/0230925 describes a rock excavator having a cutter head mounting a plurality of annular disc cutters suitable to operate in an undercutting mode.

Further, different types of devices for the installation of rock bolts are known in the art. Such devices comprise a supporting structure carrying a bolting unit, wherein the bolting unit is configured for drilling a drill hole and moving a rock bolt into a rock face in order to secure the roof of a tunnel or subterranean roadway.

Since the devices for the installation of rock bolts often form part of a cutting apparatus suitable for creating tunnels and subterranean roadways, the bolting process must not lead to a delay of the generation of the tunnel. In order to accelerate the installation of the rock bolts, devices have been developed which are able to simultaneously drill two or more installation holes into the rock face.

Typically, a mesh structure covering the rock face is used for additional protection against roof fall. Such a mesh typically is fixed by means of the bolts installed by the device for installation of rock bolts.

For placing the mesh against the roof, a so called mesh handler is used. US 2012/0213598 A1 discloses such a mesh handler. The system includes a support frame, a lifting system and a feeding system. The support frame holds a plurality of mesh sheets which are fed by the feeding system in a longitudinal direction of the vehicle. The feeding system obtains at least one sheet from the lifting system and feeds the sheet towards installation apparatus for installation on the mine roof. However, it is difficult to cover the whole roof of the mine, in particular when the roof is curved, with such a device.

A further mesh handling device which is able to apply a mesh to a curved roof is disclosed in U.S. Pat. No. 8,137,033 B1. This device uses a flexible rolled and folded mesh which is pulled from a rearward end of the mining machine along with the machine direction to a forward end, defolded and placed by means of four arms which are flexible against the roof. Even though this device is improved, in that a larger single mesh is used instead of a plurality of mesh sheets which must be separately placed in overlapping manner with the roof, even this device is still complicated, in particular it is complicated to place the mesh at the desired position and hold it safely, while bolting.

A further drawback is that the manipulator comprising the arms needs a certain amount of space and must be able to reach the whole profile section of the roof. Moreover, by means of these arms, the mesh can only be positioned step by step. This means that the manipulator starts unrolling the mesh and holds it against the roof. Now the manipulator needs to stay until bolting is finished in this bolting position and subsequently can be advanced to the next position for the next bolting.

Further mesh handling devices are disclosed in RU 2522325, WO 2014/028924 A1, US 2008/0279627 A1, WO 02103162 A1, U.S. Pat. No. 5,816,750 and GB 1244574. All these devices suffer from the above drawbacks.

SUMMARY OF THE INVENTION

It is an objective of the present invention to provide a mesh handler for a mining machine allowing accelerated mesh placement and mesh handling, as well as simple and proper placement of a mesh at the roof of a tunnel or a subterranean roadway. It is a further objective of the present invention to provide a mining machine which allows accelerated mesh placement and mesh handling, as well as simple and proper placement of a mesh at the roof of a tunnel or a subterranean roadway.

This objective is achieved by providing a mesh handler for a mining machine comprising a generally U-shaped frame for receiving and positioning a mesh against a roof portion of an underground tunnel. Such a roof portion will in many cases also be generally U-shaped.

The frame includes at least one generally U-shaped rail. The mesh handler moreover includes guide means for guiding the mesh along the rail in a direction substantially perpendicular to a longitudinal direction of the mining machine. The U-shaped frame, according to this invention, is used to push the mesh against the roof portion of the underground tunnel. It shall be understood that U-shaped in this instance, as it is related to a roof portion having general U-shape or to the frame, does not necessarily mean that the frame is arc-shaped or formed as a partial circle. Much more, also an arrangement, in which the legs of the U are substantially rectangular to the U's back, is considered as U-shaped. Nevertheless, most roof portions of subterranean tunnels comprise a certain curvature and are concavely formed. The frame which preferably provides the structure of the mesh handler includes a generally U-shaped rail. This rail preferably extends substantially perpendicular to the longitudinal direction of the mining machine. The longitudinal direction of the mining machine in most cases will be substantially aligned with the longitudinal direction of the subterranean tunnel and therefore, the U-shaped rail extends perpendicular to the longitudinal direction of the subterranean tunnel.

The mesh handler includes guide means for guiding the mesh along the rail in a direction substantially perpendicular to a longitudinal direction of the mining machine and thus, in most cases, also perpendicular to a longitudinal direction of the underground tunnel. According to the invention, the mesh therefore is guided and fed in a direction perpendicular to the longitudinal direction of the mining machine and preferably the tunnel and along a lateral or transverse direction of the underground tunnel. The mesh handler is adapted to handle a flexible mesh which preferably is rolled, and not for handling stiff mesh sheets. Thus, the mesh is guided from one side of the mining machine by means of the guide means along the rail to the other side of the mining machine and positioned by means of the frame against the roof portion of the underground tunnel. The portion covered by the mesh is determined by the length and the width of the mesh while the width of the mesh is measured in the longitudinal direction of the underground tunnel. Using a wider mesh can therefore lead to a substantially increased coverage by one mesh and thus accelerates the meshing of the roof, while a large width of the mesh might have certain drawbacks in respect of bolting.

In an advantageous embodiment of the mesh handler the guide means comprise at least one pull-out mechanism for pulling the mesh along the rails for arranging the mesh on the frame. Such a pull-out mechanism preferably is adapted to engage a mesh for pulling the mesh along the rail. The pull-out mechanism may be driven automatically by means of a motor or the like, or actuated manually by an operator. The pull-out mechanism preferably is adapted to pull a mesh generally perpendicular to a longitudinal direction of the mining machine.

According to a particular preferred embodiment, the mesh handler includes at least two generally U-shaped rails, arranged substantially in parallel and fixed to each other. Having two rails which are arranged parallel to each other, is beneficial in view of supporting the mesh during both, while pulling out the mesh and arranging it on the frame and while holding the mesh and positioning the mesh against the roof portion of the underground tunnel. Preferably a distance between the two rails is chosen such that the distance is smaller than the width of the mesh to be positioned.

Preferably, the U-shaped rails are interconnected by means of rods, wherein the position of the rods relative to the rails is adjustable. In one example, four rods are used and in another example six rods are used. The number of rods depends on the bolting pattern and profile dimension. Thus, the specific number of rods is of minor importance. The position of the rods preferably is adjustable relative to each other. This is advantageous, when a bolting rig is arranged under the frame and thus needs to drill and bolt through the frame. Dependent on the position of the bolts, the position of the rods interconnecting the rails can be chosen.

In a further preferred embodiment the at least one U-shaped rail includes at least one hinge so that a curvature of the U-shaped rail is adjustable to meet a profile of the roof portion of the underground tunnel. The roof portion of the underground tunnel may vary along the tunnel, or between different tunnels, when the mesh handler is used for different mining projects. When positioning the mesh against the roof portion, it is beneficial when the frame profile and thus the curvature of the at least one U-shaped rail meets a curvature of the roof portion as proper as possible. This helps to properly position the mesh and thus to fix the mesh in a proper way against the roof portion so that safety of the underground tunnel is increased. Preferably, the at least one U-shaped rail includes two hinges, three hinges, four hinges, five hinges, six hinges, seven hinges or eight hinges. Depending on the width of the roof profile of the underground tunnel, a different number of hinges may be preferred. In general, two to four hinges have been shown in practise to be sufficient for most application cases.

In an advantageous embodiment, the U-shaped rail includes a fixed central portion and at least first and second arms pivotally hinged against the central portion. According to such an embodiment, the U-shaped rail includes two hinges. The central portion is fixed with respect to a support, supporting the mesh handler on the mining machine or the like. On two axial ends of the fixed central portion, the first and the second arms are pivotally mounted. In an embodiment comprising two U-shaped rails, both rails are preferably formed substantially identical. In such an embodiment, also the second U-shaped rail includes a fixed central portion and first and second arms pivotally hinged against the central portion. The frame in such an embodiment thus has wing-like extensions or flap-like extensions and the curvature of the U-shaped rails and the frame can be adjusted with respect to the profile of the roof portion of the underground tunnel. For example, the fixed central portion forms the back of the "U" of the U-shaped rail and the first and second arms each form a leg of the "U" of the U-shaped rails.

Preferably, the U-shaped rail includes third and fourth arms, pivotally hinged against the first and second arms respectively. According to this embodiment, third and fourth arms are coupled to axial ends of the first and second arms which are each hinged against the fixed central portion. In this embodiment, the U-shaped rail includes four hinges, first and second hinges between the central portion and the first and second arms, and third and fourth hinges between the first and second arms and the third and fourth arms respectively. It shall be understood that the number of arms is preferably chosen dependent on the desired cutting profile and may range from one to five arms or more on each side of the fixed central portion. Thus, also fifth and sixth, seventh and eighth as well as ninth and tenth arms are also preferred. Preferably, the U-shaped rail is formed such that the number of arms can be chosen by the operator. It is preferably, when each arm includes a hinge portion, such that the operator may connect an additional arm or additional arms to the arm or the fixed central portion. Due to such an embodiment, the U-shaped rail and thus the mesh handler is modular and can be adapted with respect to the specific cutting operation.

Moreover, it is preferred that the mesh handler includes a drive for pivoting the first and second arms respectively. Such a drive in a first embodiment might be formed as a first and second piston drives or first a second spindle drives, which are supported at the central portion and act against the first and second arms respectively. The drive might also comprise a first spindle drive and a second piston drive. In the same manner, when the U-shaped rail includes also third and fourth arms, respective third and fourth piston drives which are supported at the first and the second arms and act against the third and fourth arms, may be provided in a preferred embodiment. It shall be noted, that for achieving the adjustability at least one arm must be adjustable, all others can be adjusted by a spindle or with cylinders. This, however, may result in a complex motion of the arms. Piston drives are preferred, since they are a simple and robust way of pivoting the single arm segments of the U-shaped rail. Moreover, mining machines are provided with a hydraulic and/or pneumatic network for supplying different assemblies with pneumatic and/or hydraulic pressure. Such a network can also be used for supplying the piston drives of the mesh handler. The pistons might be provided with a pressure relief valve, such that when the frame is pushed against the roof portion, for positioning the mesh against the roof portion, damaging of the mesh handler is prevented. When e.g. the curvature of the frame does not fit the curvature of the roof portion at a specific section of the underground tunnel, the arms might be forced to pivot, when the frame is pushed against the roof portion. In such a case, a pressure relief valve may open, thus allowing the arm segments to pivot and damage to the mesh handler can be prevented.

In a further advantageous development of the present invention, at least one rail is formed to be extendable in its length direction. Such a rail is preferably formed of two segments which are assembled together and movable with respect to each other. They are assembled to form a telescopic rail. Due to such an embodiment, it is possible to adjust a span of the frame in a transverse direction of the underground tunnel in a certain range.

In a further preferred development of the invention, the pull-out mechanism includes a traction mechanism, having at least one traction means running along the rail. Preferably, each rail is provided with such a traction mechanism, thus, when two rails are provided, two traction means running along each rail are preferred. Preferably, the rail includes a respective groove, in which the traction means runs. The traction mechanism preferably includes a drive for driving the traction means. With such traction mechanism, pulling out and positioning the mesh on the frame is greatly simplified.

Preferably, the traction means includes a chain; alternatively, the traction means includes a belt. A belt, such as a rope, steel rope, tooth belt or the like is preferred. A chain has the advantage that it is simple to drive e.g. by means of a drive sprocket and can easily be driven to a determined position, since the pitch of the chain is known. According to a further preferred embodiment, a carrier is coupled to the traction means to carry a mesh when the traction means moves along the rail. The carrier is preferably formed such that it is able to selectively couple and decouple a mesh to be positioned on the frame. A carrier may automatically grab a mesh, or may manually be brought into position by an operator. Preferably, the carrier is formed such that the carrier releases the mesh when the mesh is readily positioned on the frame.

When two U-shaped rails are provided, it is preferred that the carrier is formed as a bar, extending at least from rail to rail and having holding means for holding a mesh. Such a carrier can act as a clearing blade or clearing shield, clearing the frame from fragmented rock material lying on the frame. The bar, according to this embodiment, preferably has a length which is at least equal to the width of the mesh, preferably larger. This ensures that the frame is cleared from all fragmented material, which might hinder the mesh pull-out.

According to a further preferred embodiment, the mesh handler includes a sensor for determining a position of the carrier with respect to the frame. In specific applications it might be necessary to move the carrier to a specific position during a drilling and bolting operation, or to move the carrier to a specific position for positioning a mesh in a specific manner. It might be necessary not to position each mesh at the same lateral position within the underground tunnel, but at specific points, e.g. at crossings or the like, it might become necessary to position a mesh offset in a lateral position. Having a sensor for determining a position of the carrier with respect to the frame helps to ensure its operation. Such a sensor may be a rotary sensor coupled to a pulley or sprocket for the chain. Preferably, the sensor is calibrated when the carrier is in the starting position. Alternatively, the sensor is formed as a magnetic sensor, sensing the carrier when it moves along the rail.

According to a further preferred embodiment, the mesh handler includes a holding device for receiving a rolled mesh. Such a holding device may be formed as chute which can receive the rolled mesh. The holding device preferably is fixed against the frame, such that the position of the holding device and the frame is fixed with respect to each other. The holding device may be coupled with an axial end of the U-shaped rail, thus with an axial end of the outermost arm. So the device may be formed such that the rolled mesh is placed therein manually by an operator or by means of an automatic feeding device. The holding device may be formed such that it can receive more than one rolled mesh.

Moreover, it is preferred that the mesh handler includes a lifting device for lifting the frame against the roof portion. Such a lifting device is preferably found as a pneumatic or hydraulic device, comprising pneumatic or hydraulic cylinders. The lifting device is preferably supported on the mining machine, preferably on a frame of the mining machine.

Preferably, the lifting device allows axial movement of the frame in a longitudinal direction of the mining machine for overlapping placement of the meshes. When the mining machine moves forward, and the next mesh shall be placed, it is preferred that the lifting device can adjust the frame in the longitudinal direction so that the meshes can be placed properly. It is important that the meshes placed on the roof portion overlap each other to a certain degree, such that no gaps between meshes are present. However, it is also preferred that an overlapping portion between two meshes is not too large so that not too many drilling and bolting operations are necessary for the whole tunnel. This helps increasing efficiency of the meshing process. Alternatively, the axial movement is provided by a separate axial moving means which is not necessarily integrated with the lifting device. Such an axial movement means may be formed as a pusher bar, a plunger, a spindle or the like.

According to a second aspect of the invention, the objective defined in the introductory portion is solved by a mining machine for use in subterranean roadways, in particular suitable for creating tunnels or in subterranean roadways and the like, comprising a drive unit for moving the mining machine in a longitudinal direction and a mesh handler according to at least one of the beforehand described embodiments of a mesh handler according to the first aspect of the invention.

The longitudinal direction refers to the machine direction of the mining machine. In a first preferred embodiment of the mining machine, the mining machine further includes a cutting arm configured for a pivotal movement around at least one axis, a cutting head mounted to the cutting arm, the cutting head comprising at least one rotatable cutting element for detaching material from a rock face, and a device for the installation of rock bolts, wherein the mesh handler is arranged substantially above the device for the installation of rock bolts. And the device for installation of rock bolts preferably includes a support structure and first and second bolting units mounted to their support structure. Each of the bolting units is configured for moving a rock bolt into a rock face. The supporting structure is configured for rotatable moving the first and the second bolting units about a common axis of rotation. Several actuators are mounted to the supporting structure and configured for additionally moving at least one of the first and second bolting units.

Since the first and second bolting units are mounted to the supporting structure that is configured for rotatable moving the first and second bolting units about a common axis of rotation, the first and second bolting units can be roughly aligned to a desired orientation. The common axis of rotation of the first and second bolting units usually corresponds to or extends parallel to a horizontal central middle axis of the tunnel. In order to allow for a radial orientation of at least one of the first and second bolting units to the horizontal central middle axis of the tunnel, the first actuator can be used to adapt the orientation and/or position of at least one of a first and second bolting units after the first and second bolting units have been rotated simultaneously about the common axis of rotation. This ensures radial placement of the bolts. The first and second bolting units can be rotated such that bolts are fed to edges of the mesh to be placed and the mesh can be safely fixed against the roof portion.

BRIEF DESCRIPTION OF DRAWINGS

A specific implementation of the present invention will now be described, by way of example only, and with reference to the accompanying drawings in which.

DETAILED DESCRIPTION OF DRAWINGS

Figure 1:
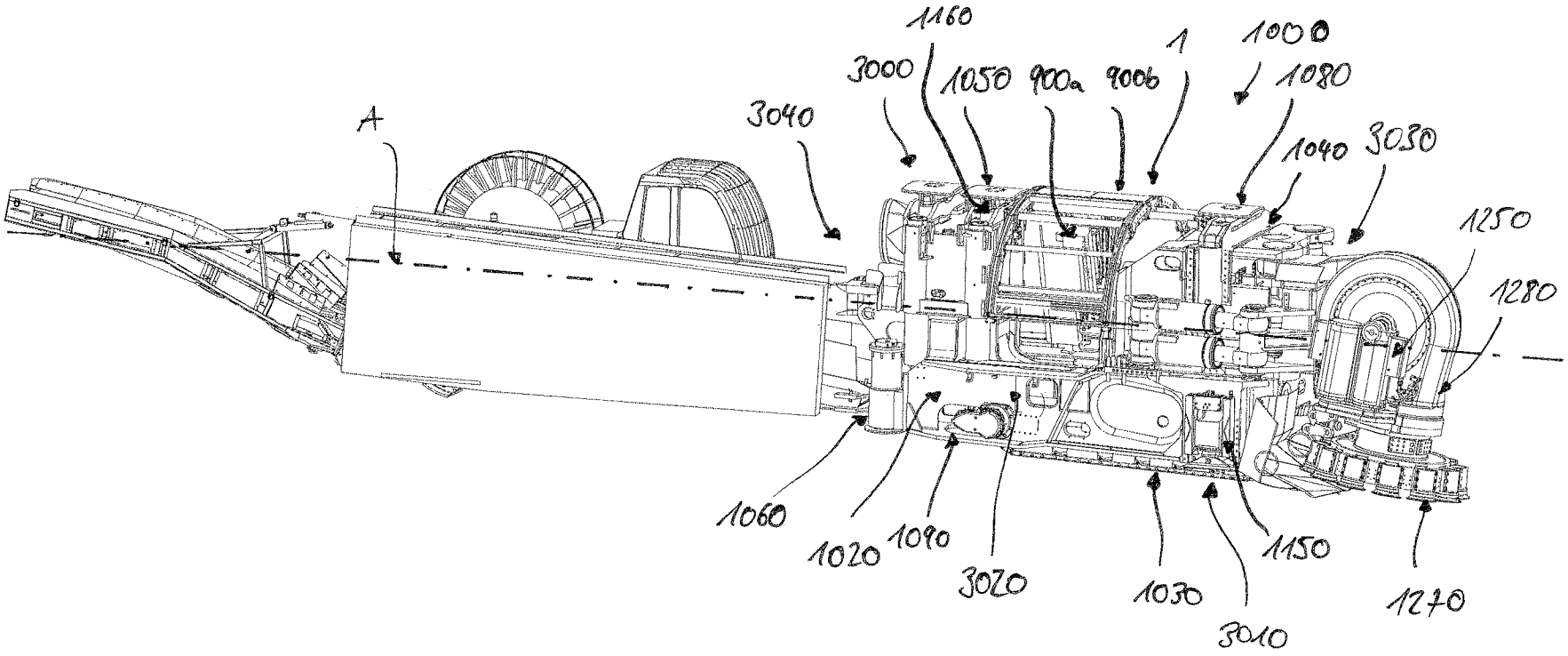
FIG. 1 is a front perspective view of a mining machine, suitable for creating tunnels or subterranean roadways having a forward mounted cutting unit and a rearward control unit and a mesh handler according to the invention.
Figure 2:
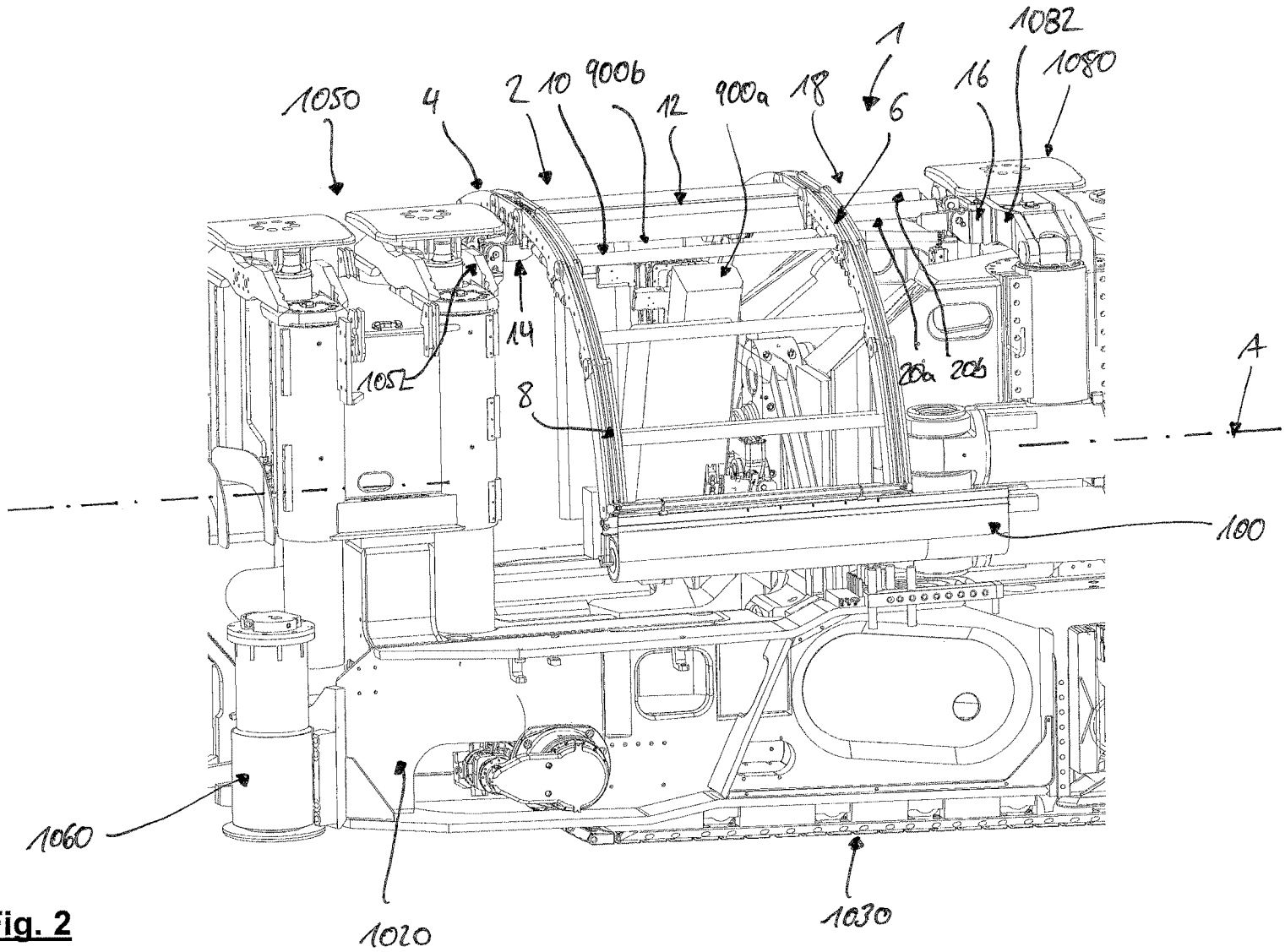
FIG. 2 is a perspective detailed view of the portion of the mining machine of FIG. 1 which includes the mesh handler.

Referring to FIG. 1, mining machine 1000 includes a main frame 1020 mounting a plurality of cutting components configured to cut into a rock or a mineral face to create tunnels or subterranean roadways.

Mining machine 1000 is configured specially for operation in undercutting mode in which a plurality of rotatable roller cutters 1270 may be forced into the rock to create a groove or a channel and then to be pivoted vertically upwards so as to overcome the reduced tensile force immediately above the groove or a channel and to break the rock. Accordingly, the present mining machine is optimized for forward advancement into the rock or a mineral utilizing less force and energy typically required for a conventional compression type cutters that utilize cutting bits or peaks mounted at rotatable heads. However, the present invention is not limited to such mining machines, but can also be used for other mining machines which advance in the rock or mineral for cutting a tunnel or subterranean roadway.

The main frame 1020 has lateral sides 3020 to be orientated towards the wall or the tunnel; an upward facing region 3000 to be orientated towards a roof of the tunnel; a downward facing region 3010 orientated to be facing the floor of the tunnel; a forward facing end 3030, intended to be positioned facing the cutting face and a rearward facing end 3040 intended to be positioned facing away from the cutting face.

An undercarriage 1090 is mounted generally below main frame 1020 and in turn mounts a pair of crawler tracks 1030 driven by a hydraulic (or electric) motor to provide forward and rearward movement of the mining machine 1000 over the ground, when in a non-cutting mode. A pair of rear ground-engaging jacking legs 1060 is mounted at frame sides 3020 towards rearward end 3040 and is configured to extend and retract linearly relative to frame 1020. A frame 1020 further includes a forward pair of jacking legs 1150 also mounted at each frame side 3020 and towards forward end 3030 and being configured to extend and retract to engage the floor tunnel. By actuating of legs 1060 and 1150, main frame 1020 and in particular tracks 1030 may be raised and lowered in the upward and downward direction so as to suspend tracks 1030 of the ground to position the mining machine 1000 in a cutting mode. A pair of roof engaging grippers 1050, 1080 project upwardly from main frame 1020 at frame rearward end 3040 and are extendable and retractable linearly in the upward and downward direction via control cylinders 1160. Grippers 1050, 1080 are therefore configured to be raised into contact with the tunnel roof and in extendable combination with jacking legs 1060, 1150 are configured to wedge the mining machine 1000 in a stationary position between the tunnel floor and roof when in the cutting mode.

A sledge 1040 is coupled to a linear hydraulic cylinder (not shown in FIG. 1) such that by reciprocating extension and retraction of this cylinder, the sledge 1040 is configured to slide linearly between frame forward and rearward ends 3030, 3040.

A pair of hydraulically actuated bolting units 900*a*, 900*b* are mounted at main frame 1020 between sledge 1040 and roof gripping unit 1050, 1160, relative to a lengthwise direction of the mining machine 1000. Bolting units 900*a*, 900*b* are configured to secure a mesh 100 (see in particular FIGS. 12 and 13) to the roof of the tunnel as the mining machine 1000 is advanced in a forward cutting direction. Above the pair of bolting units 900*a*, 900*b*, a mesh handler 1 is arranged. This mesh handler 1 will be described in more detail with reference to FIGS. 2 to 13.

For a more detailed description of the mining machine 1000, reference is made to the (non-disclosed) application PCT/EP2015/072842.

In use, the mining machine 1000 is wedged between the tunnel floor and roof via jacking legs 1060, 1150 and roof grippers 1050, 1080. The sledge 1040 may then be displaced in a forward direction, relative to main frame 1020 to engage roller cutters 1270 onto the rock face. Cutting heads 1280 are rotated (in FIG. 1 only one cutting head is shown) via motors 1250 that create the initial groove or channel in the rock face at a lowermost position. A first arm is then pivoted about its pivot axis via the respective motor to raise roller cutters 1270 along a path to achieve a second stage under a cutting operation. A first support holding the first cutting head may then be slewed in the lateral sideways direction via pivoting about a vertical axis and combined with the raising and lowering rotation of roller cutters 1270 it creates a depression or a pocket within the rock immediately forward of the first cutting arm and the respective support. The second cutting arm and associated cutting head and cutters 1270 are then actuated according to the operation of the first cutting arm involving pivoting in both the vertical and horizontal planes. This sequential dual pivoting movement of the second arm is independent of the initial dual pivoting movement of the first cutting arm. A phasing and sequencing of the pivoting arms about the pivot axis and supports about the vertical axis is controlled via a respective control unit.

When the maximum forward travel of sledge 1040 is achieved, jacking legs 1060, 1150 are retracted to engage tracks 1030 onto the ground. The tracks 1030 are orientated to be generally declined (at an angle of approximately 10° relative to the floor) such that when ground contact is made, the roller cutters 1270 are raised vertically so as to clear the tunnel floor. The mining machine 1000 may then be advanced forward via tracks 1030. Jacking legs 1060, 1150 may then be actuated again to raise tracks 1030 off the grounds and grippers 1050, 1080 move into contact with the tunnel roof to repeat the cutting cycle. The forwardmost roof gripper 1080 is mounted above slat 1040 to stabilize the mining machine 1000, when sledge 1040 is advanced in the forward direction via linearly actuating cylinders.

After each cutting operation, when the mining machine 1000 is moved forward, it is necessary to place a mesh at the tunnel roof and to fix this mesh via respective bolts. The bolts are implemented by means of the bolting units 900*a*, 900*b* after the mesh 100 has been placed by means of the mesh handler 1.

The mesh handler 1, according to this present invention, is preferably arranged between the foremost gripper 1080 and the rearmost grippers 1050 above the bolting units 900*a*, 900*b*. However, it should be understood that in other mining machines, which may comprise a different structural design, the mesh handler 1 may be placed at a different position, nevertheless it is preferred to mount the mesh handler over a respective bolting unit.

Figure 12:
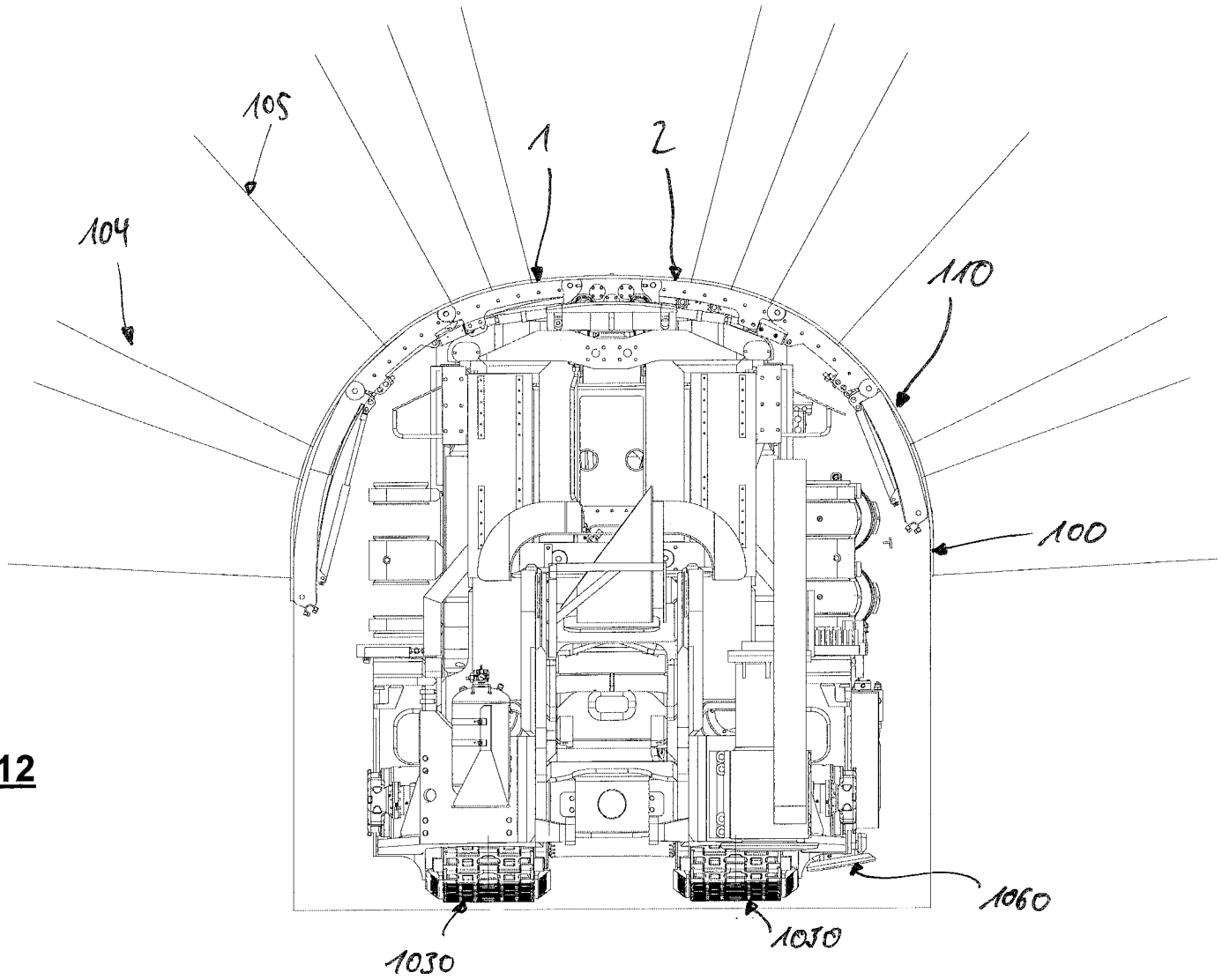
FIG. 12 is a rear-view of the mining machine of FIG. 1 within an underground tunnel and the mesh handler placed against the roof portion of the underground tunnel.
Figure 13:
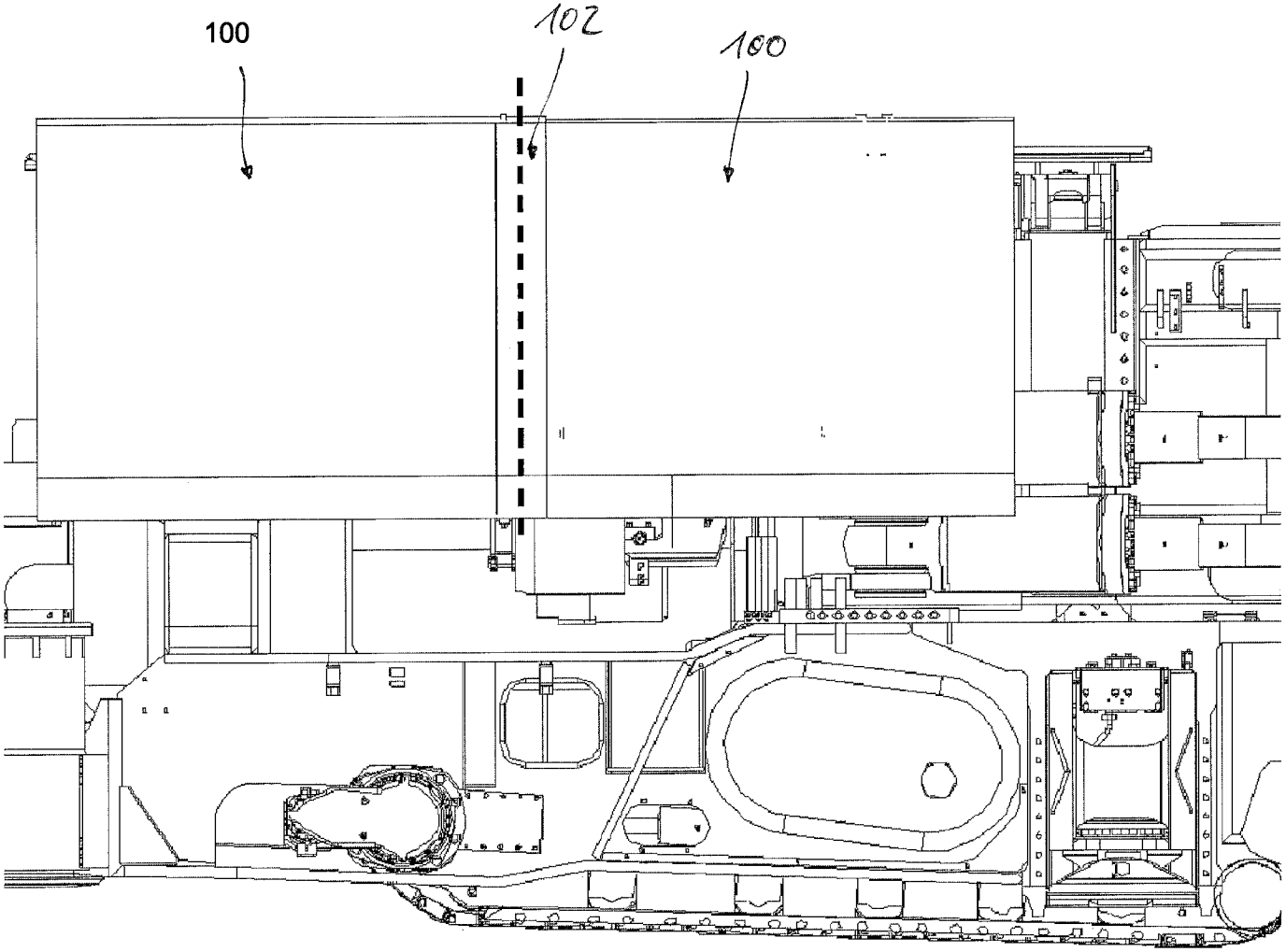
FIG. 13 is side view of the mining machine while placing a mesh against a roof portion of a tunnel.

The mesh handler 1 includes a generally U-shaped frame 2 for receiving and positioning a mesh 100 against a generally U-shaped roof 110 portion of an underground tunnel (see FIG. 12). The frame 2 has first and second generally U-shaped rails 4, 6. The frame 2 furthermore includes a guide means 8 for guiding the mesh 100 along the rails 4, 6 in a direction substantially perpendicular to a longitudinal direction A of the mining machine 1000. The mesh 100 is substantially guided along each rail 4, 6, thus along the arc-shape defined by the U-shaped rails 4, 6.

The U-shaped rails 4, 6 are interconnected by means of rods 10 (in FIG. 2 only one rod 10 depicted with reference sign) which will be described later.

Figure 10:
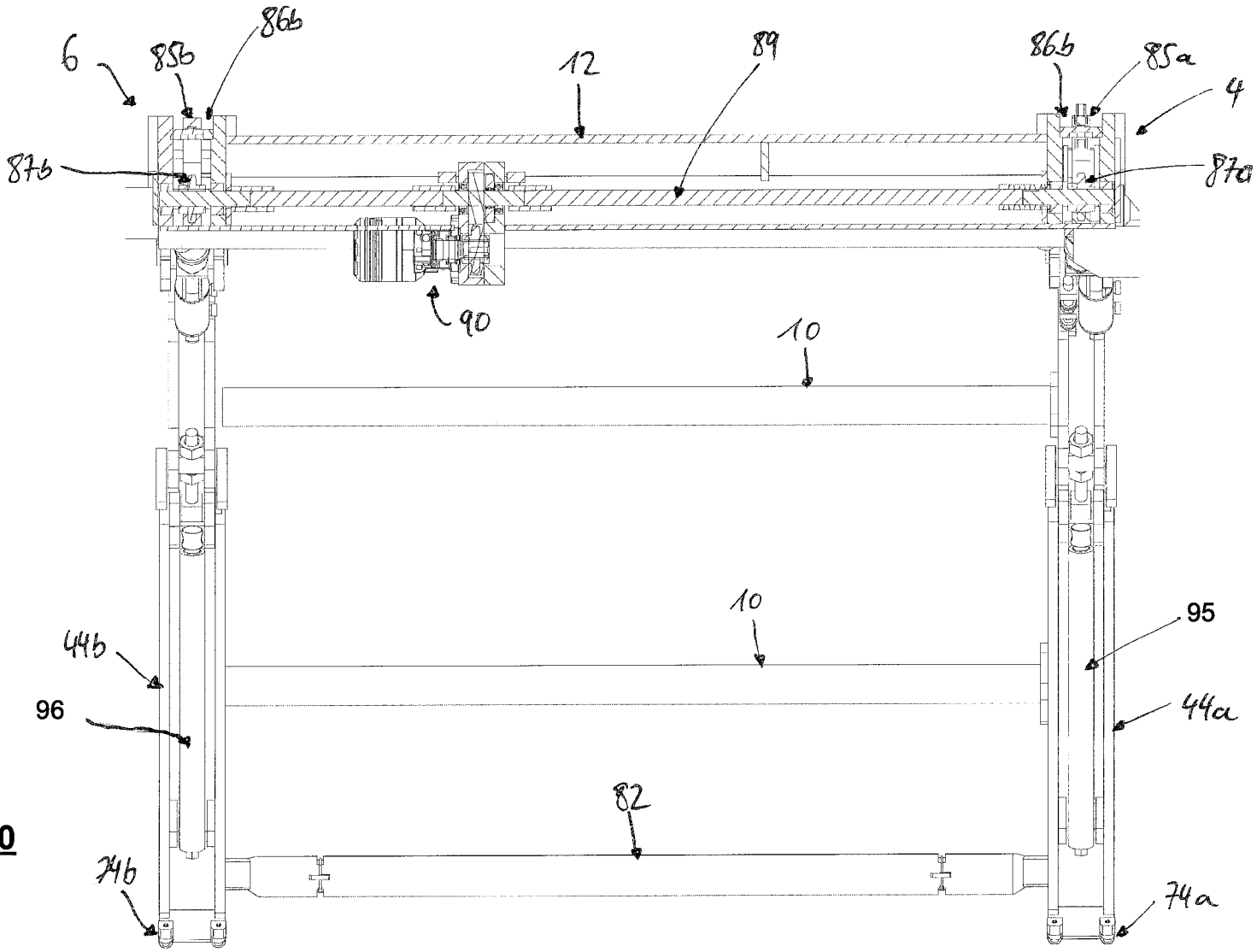
FIG. 10 is a full cut through the mesh handler along the machine direction.
Figure 11:
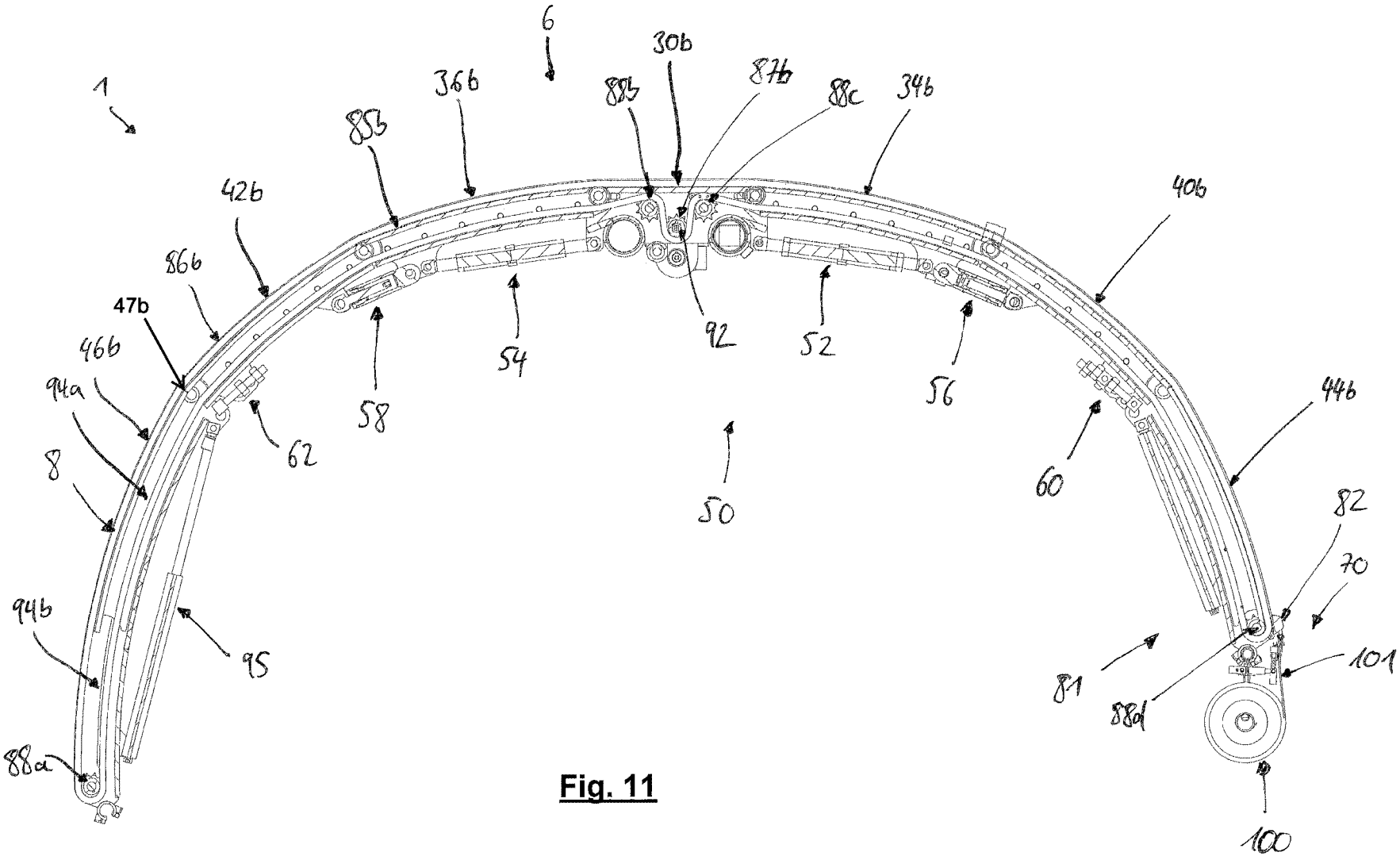
FIG. 11 is a full cut through the mesh handler perpendicular to the machine direction.

The mesh handler 1 includes a central body portion 12 housing a drive (see FIGS. 10, 11). The body portion 12 provides also a structural frame. The mesh handler 1 furthermore includes two mounting supports 14, 16 by means of which the mesh handler 1 is mounted against respective portions of the mining machine 1000. In this embodiment (see FIG. 2) the mounting supports 14, 16 are fixed against bridges 1052, 1082 of the grippers 1050, 1080. Thus, when the grippers 1050, 1080 are raised, also the mesh handler 1 is raised. The body portion 12 also houses an axial displacement arrangement 18 for moving the frame 2 in an axial direction along the axis A. This can be seen in FIGS. 3 and 4. The axial displacement arrangement 18 has two bars 20*a*, 20*b*, which connect the mounting supports 14, 16 with each other. On the bars 20*a*, 20*b*, the frame 2 with the rails 4, 6 and the body portion 12 is slideable arranged. According to FIG. 3, the frame 2 is in a first axial position P1, in which the frame 2 is moved to the rearmost mounting support 14 close to the rearmost grippers 1050, and in FIG. 4, the frame 2 is shown in a second position P2, in which the frame 2 is moved to the foremost mounting support 16 at the foremost gripper 1080. This allows that the mesh 100 is being placed in different axial positions without moving the mining machine 1000. Therefore, accurate placement of the mesh 100 is feasible.

Figure 3:
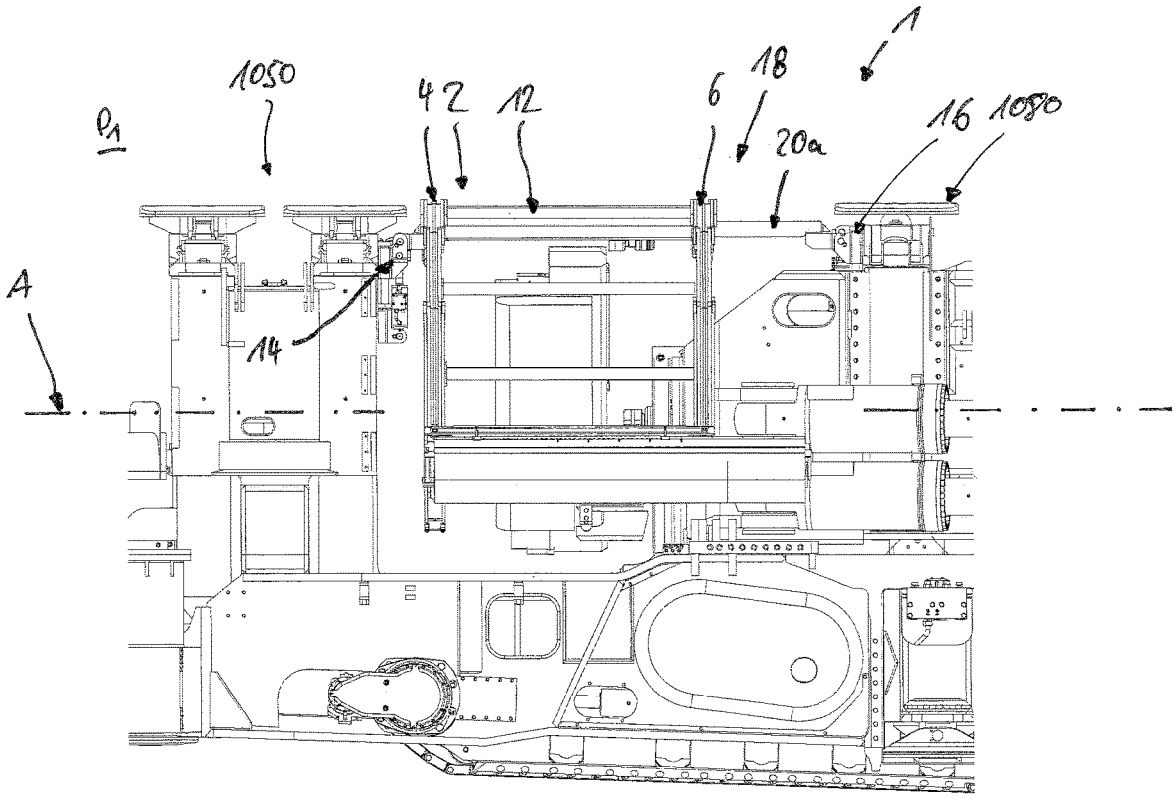
FIG. 3 is a side view of the section of FIG. 2 with the mesh handler in a first axial position.
Figure 4:
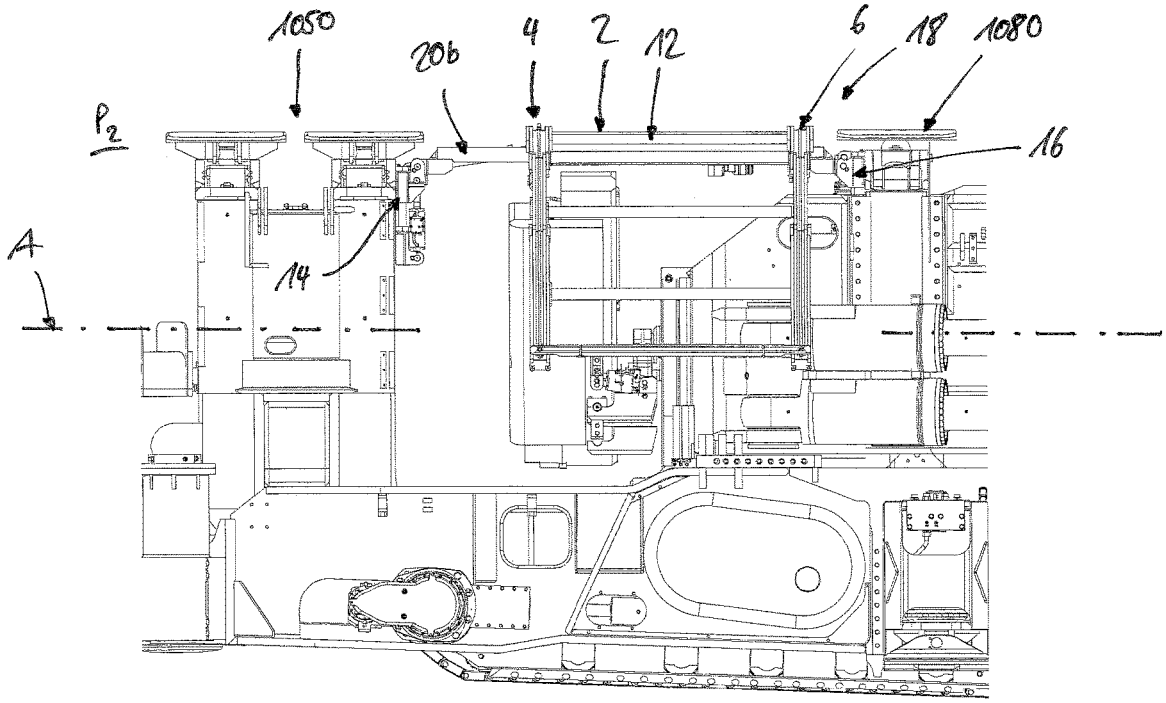
FIG. 4 is the side view of FIG. 3 with the mesh handler in a second axial position.
Figure 5:
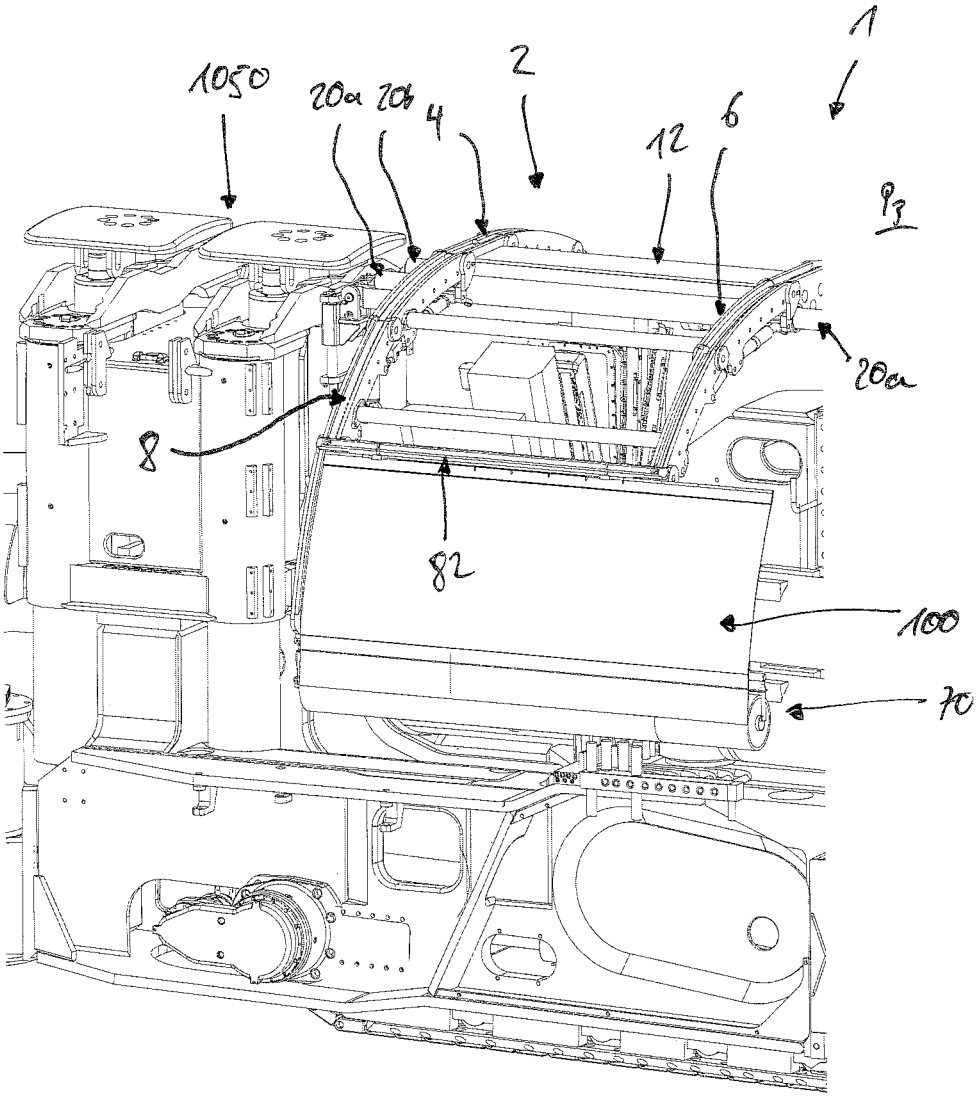
FIG. 5 is a perspective view of the section of the mining machine comprising the mesh handler with a mesh during a pull-out operation.

When a desired axial position is found (see FIG. 5), e.g. a position P3 which does not need to be one of the extreme positions P1, P2 as shown in FIGS. 3 and 4, but may also be an intermediate position P3 as shown in FIG. 5, the mesh 100 can be placed on the frame 2. In FIG. 5, an intermediate position is shown and the mesh is partially guided along the rails 4, 6. Deployment of the mesh 100 and guiding the mesh 100 along the rails 4, 6 will be described later in particular with respect to FIGS. 7 and 11.

Figure 6:
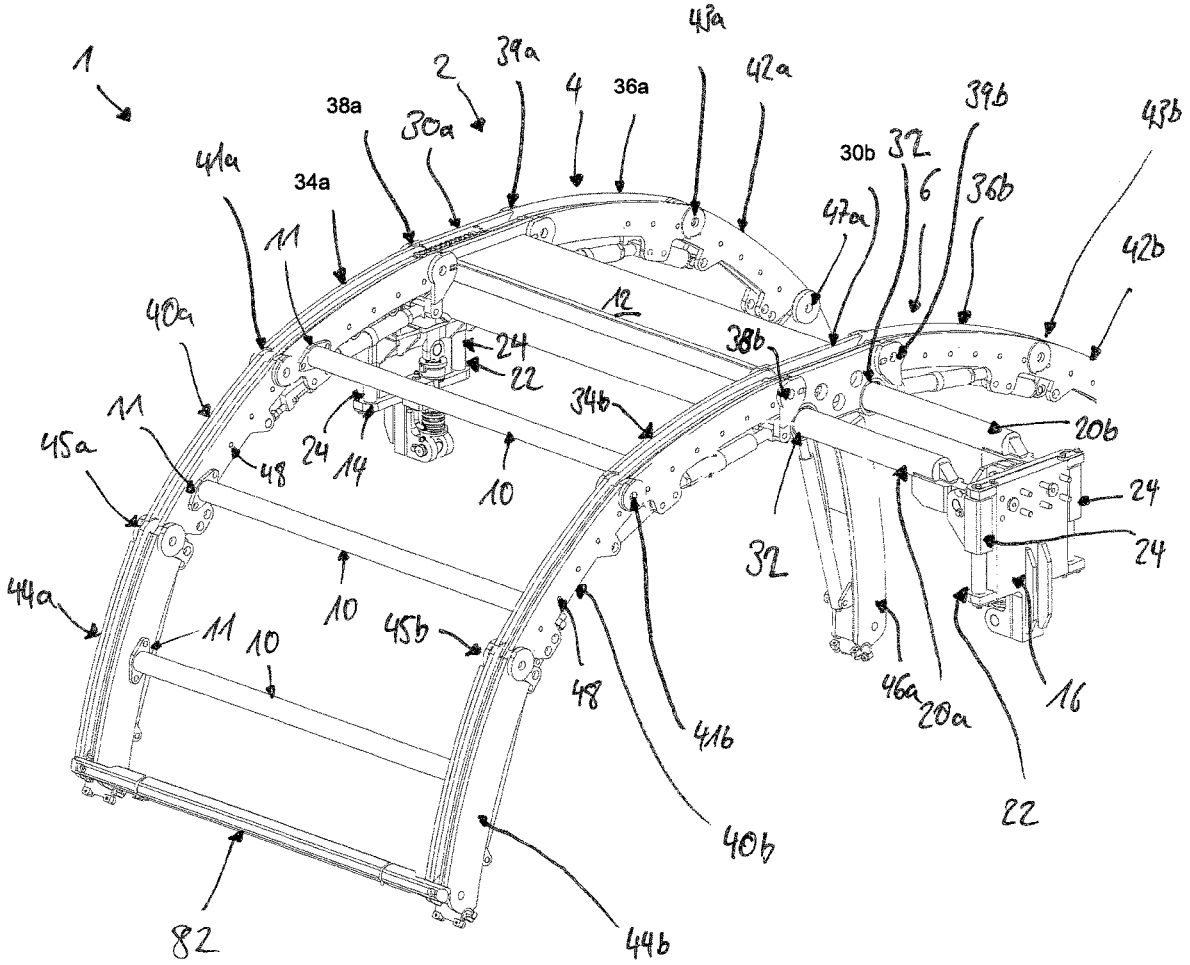
FIG. 6 is a perspective view of the mesh handler only.
Figure 7:
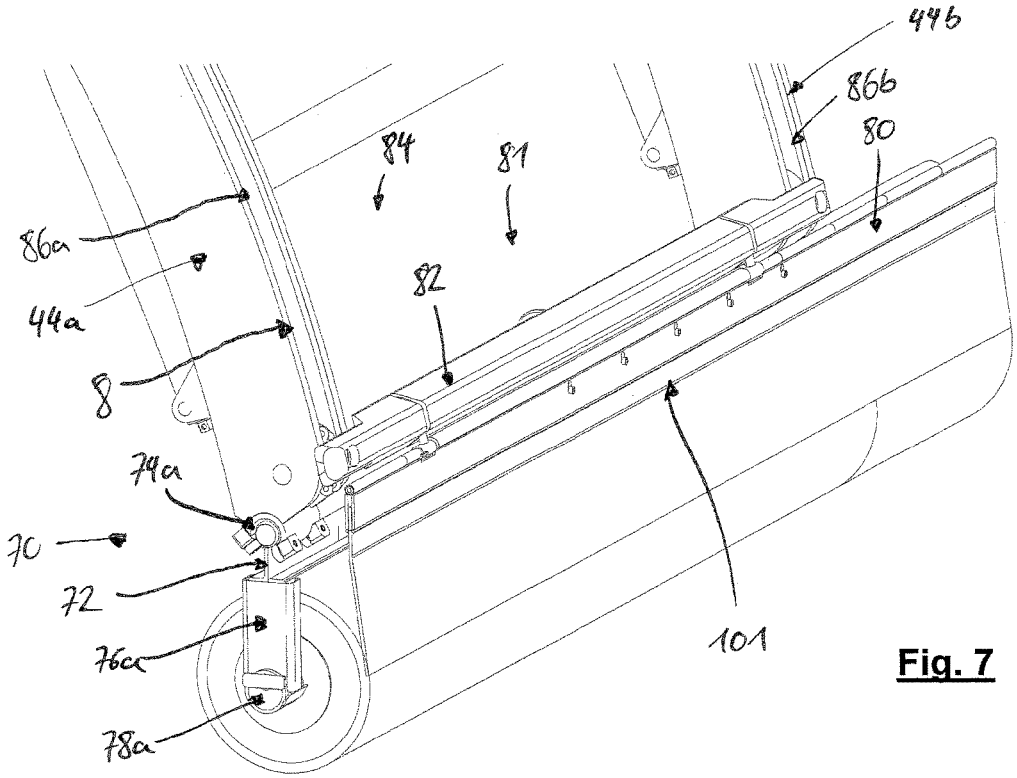
FIG. 7 is a detailed view of a rolled mesh held in the holding device.
Figure 8:
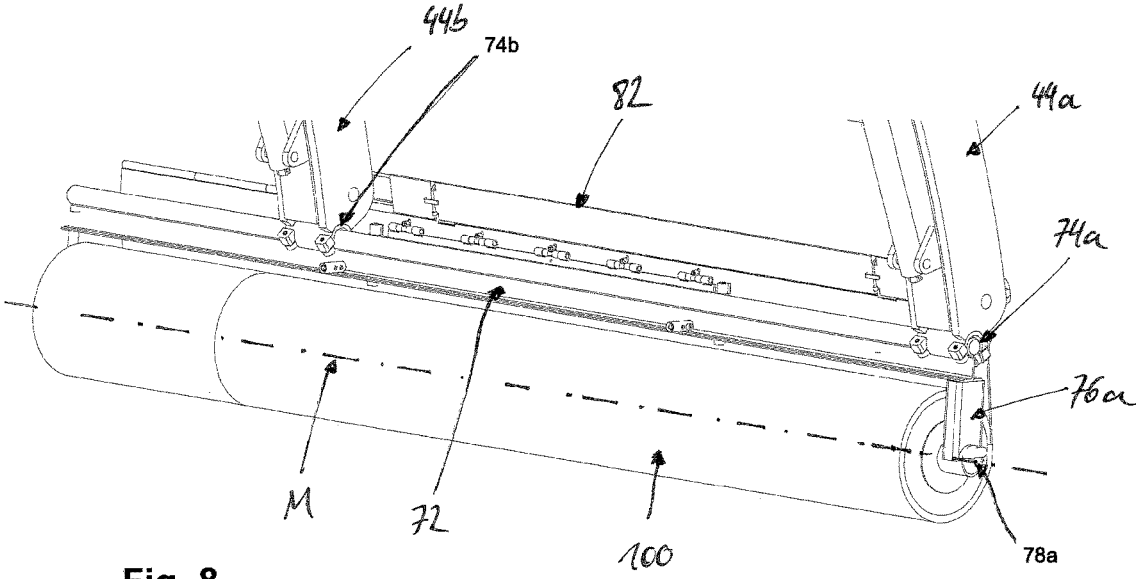
FIG. 8 is a second view of the perspective of FIG. 7.
Figure 9:
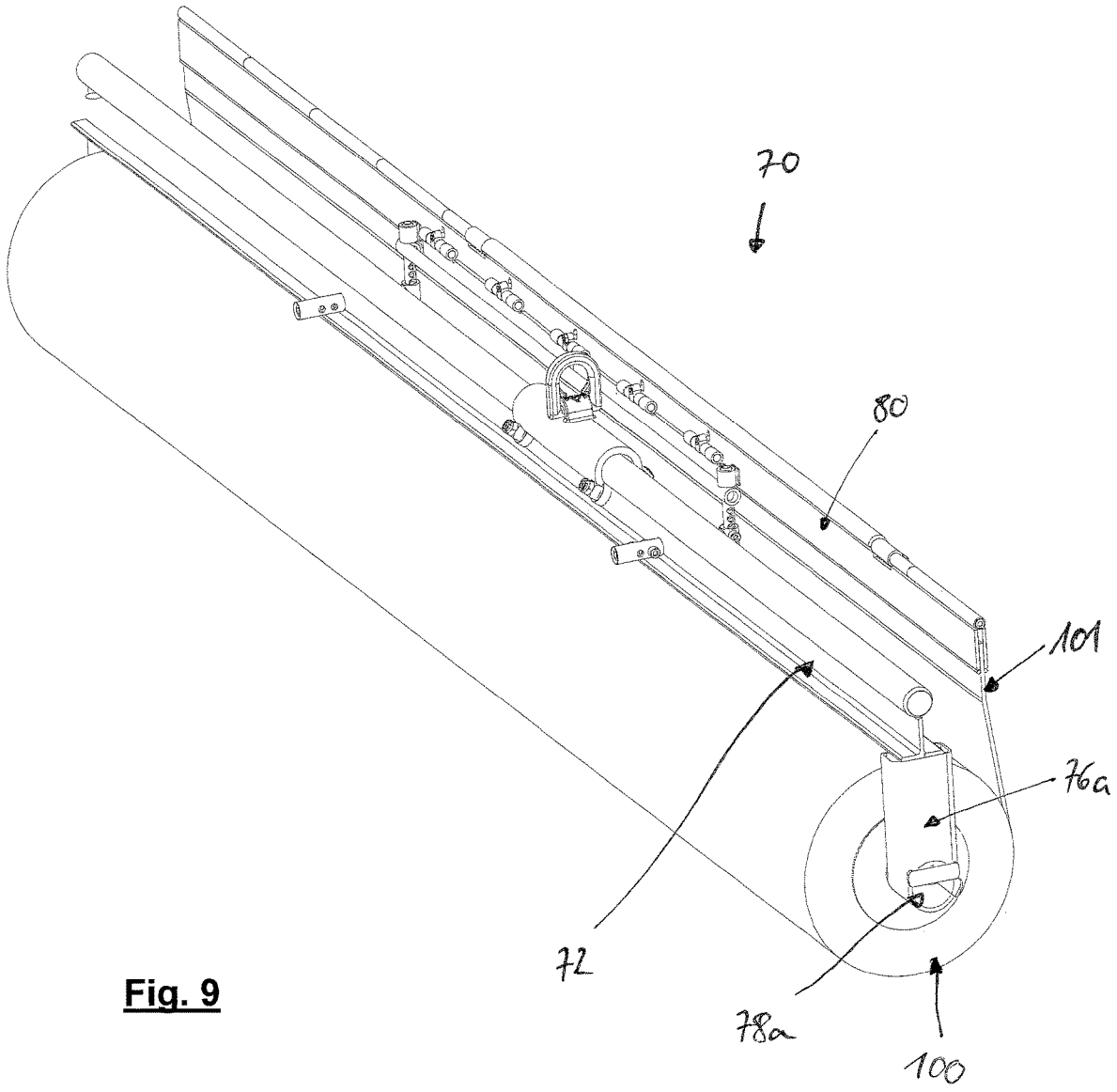
FIG. 9 is a perspective view of holding device and a carrier engaging a mesh roll received in the holding device.

In FIG. 6 a perspective view of the mesh handler 1 is shown. Again, the mesh handler 1 includes a frame 2, first and second rails 4, 6, as well as a body portion 12. Via the two bars 20*a*, 20*b*, the frame 2 is mounted to the mounting supports 14, 16. The mounting supports 14, 16 have a lifting device 22 including hydraulic cylinders 24 for lifting the bars 20*a*, 20*b* and thus the frame 2.

Each rail has a fixed central portion 30*a*, 30*b* connected to the body portion 12. The central portions 30*a*, 30*b* comprise ring guides 32 (only 2 shown in FIG. 6) for guiding the central portions 30*a*, 30*b* along the bars 20*a*, 20*b*.

Against the central portions 30*a*, 30*b*, first and second arms 34*a*, 34*b*, 36*a*, 36*b* are connected via first hinges 38*a*, 38*b* and second hinges 39*a*, 39*b*, respectively. In some applications it might be sufficient to only have the first arms 34*a*, 34*b* and the second arms 36*a*, 36*b*, however as shown in FIG. 6, additional arms are provided.

In this exemplary embodiment, a third arm 40*a*, 40*b* is connected to the first arm 34*a*, 34*b* via a third hinge 41*a*, 41*b*. Respectively, a fourth arm 42*a*, 42*b* is connected to the third arm 36*a*, 36*b* via a respective fourth hinge 43*a*, 43*b*. Moreover, a fifth arm 44*a*, 44*b* is connected via a fifth hinge 45*a*, 45*b* to the third arm 40*a*, 40*b*. Respectively, a sixth arm 46*a*, 46*b* is connected to the fourth arm 42*a*, 42*b* via a sixth hinge 47*a*, 47*b* (see FIG. 11).

Each arm 34*a*, 34*b*, 36*a*, 36*b*, 40*a*, 40*b*, 42*a*, 42*b*, 44*a*, 44*b*, 46*a*, 46*b* is connected with its respective counterpart of the first and second rails 4, 6, respectively via a rod 10. Each rod 10 includes at its axial ends respective fixing plates 11 which can be screwed against the respective arm. At the arms, a plurality of screw-threaded bolts 48 (in FIG. 6 only 2 are depicted with a reference sign) are provided, such that the position of the rods 10 can be adjusted. The rods 10 provide a certain degree of stiffness to the frame 2 and also support the mesh 100 laying on them.

Now, turning to FIG. 11, the drive for pivoting the arms 34*a*, 34*b*, 36*a*, 36*b*, 40*a*, 40*b*, 42*a*, 42*b*, 44*a*, 44*b*, 46*a*, 46*b* will be described.

In FIG. 11, a cut through the second arm 36*b* is shown, viewed in a direction away from the first arm 4. The second arm 36*b* is formed as described before and includes a fixed central portion 30*b*, first and second arms 34*b*, 36*b*, third and fourth arms 40*b*, 42*b* and fifth and sixth arms 44*b*, 46*b*. Rail 6 is provided with a drive 50 for pivoting the arms 34*b*, 36*b*, 40*b*, 42*b*, 44*b*, 46*b*. The drive 50 includes a first drive spindle 52 for mechanical adjustment and be as flexible as possible, which is supported at the central portion 30*b* and a portion of the first arm 34*b* and a second pneumatic drive cylinder 54, supported between the central portion 30*b* and a portion of the second arm 36*b*. When extending the spindle 52 and the cylinder 54, the first and second arms 34*b*, 36*b* are pivoted upwardly with respect to FIG. 11, and downwardly when the spindle 52 and/or the cylinder 54 is retracted, respectively. Moreover, angle adjustment means 56, 58 are provided between the first arm 34*b* and third arm 40*b*, as well as between the second arm 36*b* and the fourth arm 42*b*. These angle adjustment means 56, 58 comprise a screw-threaded bolt and a respective housing, such that the angular relationship between the first and third arms 34*b*, 40*b* as well as the second end fourth arm 36*b*, 42*b* can be adjusted.

Similarly, angle adjustment means 60, 62 are provided between the third and fifth arms 40*b*, 44*b* as well as between the fourth and sixth arms 42*b*, 46*b*. They are similar to the angle adjustment means 56, 58 or the spindle 52 and cylinder 54.

As can be seen in FIG. 11, the fifth arm 44*b* is provided with a holding device 70, holding a rolled mesh 100. This holding device 70 can best be seen in FIGS. 7 to 9. The holding device 70 includes a support bar 72, being received in respective clamping openings 74*a*, 74*b* at axial ends of the fifth arms 44*a*, 44*b*. It shall be understood, when a lower number of arms is used, the respective clamping openings 74*a*, 74*b* can be provided at e.g. the third arm 40*b*, or also the second arm 36*b* for instance.

At both axial ends of the support bar 72, respective holding fingers 76*a*, 76*b* are fixed. These holding fingers 76*a*, 76*b* include an engagement section 78*a*, 78*b* for engaging the rolled mesh 100 in such a manner that it is turnable about its axis M (see FIG. 8). The holding fingers 76*a*, 76*b* are formed such that an operator can easily remove an empty roll and place a new rolled mesh 100 within the holding device 70.

A free end 101 of the mesh 100 is received clamping bar 80 which itself is pivotally fixed against bar 82. Together the clamping bar 80 and the bar 82 form a carrier 81 which is part of a pull-out mechanism 84.

The guide means 8 include the pull-out mechanism 84. Besides the bar 82, the pull-out mechanism 84 includes traction means 85*a*, 85*b* which are formed as chains. The chains 85*a*, 85*b* run in respective grooves 86*a*, 86*b*, formed along the rails 4, 6. Within the rails 4, 6, a drive sprocket 87*a*, 87*b* is provided and a plurality of pulleys 88*a*, 88*b*, 88*c*, 88*d* (see FIG. 11). The sprocket 87*a*, 87*b* are mounted on a common drive shaft 89 which is driven by means of a motor 90 (see FIG. 10). Motor 90 is housed within the housing 12. The bar 82 is connected in a fixed manner to the chains 85*a*, 85*b*, thus drivable by means of the chains 85*a*, 85*b* along the rails 4, 6 from one end to the other end. As for example, shown in FIG. 5, bar 82 is moved to an intermediate position and the mesh 100 is partially pulled out. The drive sprocket 87*b* is provided with a sensor 92 sensing the revolutions of sprocket 87*b*, such that when the pitch of the chains 85*a*, 85*b* is known, also the position of the bar 82 along the rails 4, 6 is known.

Since the chains 85*a*, 85*b* are not elastic, however, the curvature of the bars 4, 6 may vary due to the drive 50, the sixth arm 46*a*, 46*b* is formed as an extendable arm. This can best be seen in FIG. 11. Arm 46*b* includes first and second portions 94*a*, 94*b* and a mechanical tensioning spindle 95 acting on both portions 94*a*, 94*b*. The arm portions 94*a*, 94*b* are telescopable to each other, thus a length of the arms 46*b* is adjustable. It shall be understood that the sixth arm 46*a* of the first rail 4 is formed in the same manner. This helps keeping the chains 85*a*, 85*b* under tension, even if the curvature of the rails 4, 6 varies. It also is desirable to have the same mesh length on both sides. Shown in FIG. 12, with this variation it is possible to reach the mesh with the last bolts.

Moreover, also the fifth arms 44*a*, 44*b* may be formed in such a telescopic manner and comprise mechanical tensioning spindle 96 (see FIG. 10). Nevertheless, it is not essential that both, the fifth and the sixth arms 44*a*, 44*b*, 46*a*, 46*b* are formed in a telescopic manner.

When a mesh 100 shall be applied to a roof portion 110 of the underground tunnel (see FIG. 12), first a rolled mesh 100 is fixed to the holding device 70 by means of the fingers 76*a*, 76*b*. A free end portion 101 is fixed to the clamping bar 80 in a manual manner, in that an operator wedges the end portion 101 into the clamping bar 80. Now, the drive 90 is switched on and bar 82 is moved along the rails 4, 6 by means of the chains 85*a*, 85*b* which are driven by the drive sprockets 87*a*, 87*b*. While moving along the rails 4, 6, the bar 82 guides the mesh along the rails 4, 6, at the same time clears the rails 4, 6 off fragmented rock materials lying on the rails 4, 6. The bar 82 is thus formed as a shield. When the bar 82 has moved from its initial position (see FIGS. 7, 8 and 11, for example) to the end position in which the bar 82 is substantially at the position of pulley 88*a*, the frame 2 will be raised by means of the lifting device 22 and positioned in an axial way by means of the axial displacement arrangement 18. It is important that the meshes 100 are placed in an overlapping manner, such that an overlapping portion 102 is formed (see FIG. 13). According to FIG. 13, the first mesh 100 on the left hand side has already been placed and fixed to the roof 110 and currently, the second, subsequent, mesh 100 on the right hand side is placed and will be fixed by bolting in the next step. An overlapping portion 102 is provided such that no gaps are present between two meshes 100. It is also important that bolts are implemented in this overlapping portion 102, such that the meshes 100 are commonly fixed.

FIG. 12 illustrates the bolting implementation. The frame 2 has already been raised against the roof portion 110 of the tunnel, such that the mesh 100 is positioned against this roof portion 110. Now, the bolting rigs 900*a*, 900*b* will be activated and bolts will be implemented according to a predetermined bolting pattern 104, indicated by the lines 105 (only one line indicated with reference sign in FIG. 12) above the roof portion 110 in FIG. 12. It shall be understood that not one bolt is being implemented for every line 105, but that also a subgroup of the lines 105 forms a bolting pattern 104.

When the bolting operation is finished, the frame 2 can be lowered again, such that it is not in contact with the roof portion 110 of the tunnel. Subsequently, the bar 82 can be moved backwards again to the initial position (see FIGS. 7 and 8). The empty mesh roll is detached from the holding device 70, a new roll is placed in the holding device 70 and again a free end portion 101 is clamped in the clamping bar 80. Now the next mesh can be set.

The invention claimed is:

1. A mesh handler for a mining machine, comprising:

a generally U-shaped frame arranged to receive and position at least one mesh against a roof portion of an underground tunnel, the frame including at least two generally U-shaped rails arranged substantially in parallel and fixed to each other; and a guide mechanism arranged to guide the at least one mesh over the at least two generally U-shaped rails in a direction substantially perpendicular to a longitudinal direction of the mining machine, the guide mechanism including at least one pull-out mechanism arranged to pull the at least one mesh along the at least two generally U-shaped rails for arranging the at least one mesh over the frame.

2. The mesh handler according to claim 1, wherein the at least two generally U-shaped rails are interconnected by rods, wherein a position of the rods relative to the at least two rails generally U-shaped is adjustable.

3. The mesh handler according to claim 1, wherein each of the at least two generally U-shaped rails includes at least one hinge, such that a curvature of the at least two generally U-shaped rails is adjustable to meet a profile of the roof portion of the underground tunnel.

4. The mesh handler according to claim 1, wherein each of the at least two generally U-shaped rails include a fixed central portion and at least first and second arms pivotally hinged against the central portion.

5. The mesh handler according to claim 4, wherein each of the at least two generally U-shaped rails include third and fourth arms pivotally hinged against the first and second arms respectively.

6. The mesh handler according to claim 4, further comprising a drive for pivoting the first and second arms respectively.

7. The mesh handler according to claim 1, wherein at least one rail of the at least two generally U-shaped rails is formed to be extendable in a length direction thereof.

8. The mesh handler according to claim 1, wherein the at least one pull-out mechanism includes a traction mechanism having at least one traction device running along the at least one rail of the at least two generally U-shaped rails.

9. The mesh handler according to claim 8, wherein the at least one traction device is a chain.

10. The mesh handler according to claim 8, wherein a carrier is coupled to the at least one traction device to carry the at least one mesh when the at least one traction device moves along the at least one rail of the at least two generally U-shaped rails.

11. The mesh handler according to claim 10, wherein the carrier is formed as a bar extending at least from one of the at least two generally U-shaped rails to another one of the rails and having a holding device arranged to hold the at least one mesh.

12. The mesh handler according to claim 10, further comprising a sensor arranged to determine a position of the carrier with respect to the frame.

13. The mesh handler according to claim 1, further comprising a holding device arranged to receive a rolled mesh.

14. The mesh handler according to claim 1, further comprising a lifting device arranged to lift the frame against the roof portion.

15. The mesh handler according to claim 14, wherein the lifting device allows axial movement of the frame in a longitudinal direction of the mining machine for overlapping placement of a plurality of meshes.

16. A mining machine for creating tunnels or in subterranean roadways and the like, comprising:

a drive unit arranged to move the mining machine in a longitudinal direction; and a mesh handler according to claim 1.

17. The mining machine according to claim 16, further comprising:

a cutting arm configured for pivotal movement around at least one axis;

a cutting head mounted to the cutting arm, the cutting head having at least one rotatable cutting element for detaching material from a rock face; and a device for the installation of rock bolts, wherein the mesh handler is arranged substantially above the device for the installation of rock bolts.

* * * * *